United States Patent [19]

Nardone

[11] 4,377,012

[45] Mar. 22, 1983

[54] SOLE PRESS PAD BOX

[75] Inventor: John M. Nardone, Wakefield, Mass.

[73] Assignee: Bush Universal, Inc., Woburn, Mass.

[21] Appl. No.: 292,269

[22] Filed: Aug. 12, 1981

[51] Int. Cl.[3] ..... A43D 63/00

[52] U.S. Cl. ..... 12/16.4

[58] Field of Search ..... 12/16.1, 16.2, 16.3, 12/16.4

[56] References Cited

U.S. PATENT DOCUMENTS

| | | | |
|---|---|---|---|
| 2,916,750 | 12/1959 | Ralphs et al. | 12/16.4 |
| 3,081,469 | 3/1963 | Muhlbach | 12/16.4 |
| 3,345,660 | 10/1967 | Peterson | 12/16.4 |

*Primary Examiner*—Patrick D. Lawson

*Attorney, Agent, or Firm*—Wolf, Greenfield & Sacks

[57] ABSTRACT

An improved pad box for use in a shoe sole attaching press supports the shoe and sole in a manner which applies pressure along the sole over a wide range of sizes and heel heights with improved, more uniform pressure distribution. The pad box supports a number of compressible, rubber-like pads which are arranged so that they may slide with respect to each other so that their upper surfaces can conform to the contour of the shoe bottom. The arrangement of compressible pads is supported by the bottom of the pad box which has a special construction including a number of links and trays. The links and trays are arranged to provide additional freedoms of motion which enable the compressible pads to shift about with greater freedom and over a wider range of shoe bottom contours than with prior devices. The pad box provides proper distribution of pressures while requiring reduced overall levels of force.

9 Claims, 4 Drawing Figures

SOLE PRESS PAD BOX

BACKGROUND OF THE INVENTION

This invention relates to improvements in machines for adhesively attaching a shoe outsole to the bottom of a shoe assembly in an operation known as sole pressing. In a typical sole pressing procedure, an outsole and the bottom of the shoe assembly to which the outsole is going to be attached are precoated with suitable adhesive and the outsole in placed lightly on the bottom of the shoe assembly. The shoe assembly with outsole lightly attached then is placed into a sole press which presses the outsole very firmly against the bottom of the shoe for a length of time to form and maintain the sole against the contour of the shoe assembly while the adhesive sets. The sole pressing machine typically will have a pad, usually in the form of a solid rubber, on which the shoe is placed and against which the shoe and outsole are pressed. The shoe assembly with lightly attached outsole is pressed against the pad, usually by a pair of toe and heel abutments which engage the toe and heel portions of the shoe assembly, press the sole and hold it in a pressed position until the adhesive cures, for example, ten to twenty seconds.

It is very important that the outsole is pressed against the shoe bottom fully and firmly along the complete area where the outsole is to be cemented to the shoe bottom. In addition, the pressure which is applied to the outsole should be sufficient to press the outsole to conform closely to the shape of the shoe bottom. Because of the complex, compound curves characteristic of a typical shoe bottom, some flexibility typically has been necessary in the pad to enable it to conform to the shoe bottom to assure reasonably uniform pressure over the complete surface of the shoe bottom.

Although it would be ideal to have a pad which conforms precisely to the bottom of the shoe assembly being operated on, the ranges of shoe styles, sizes and heel heights make such an ideal impractical. It would be necessary to change pads each time a shoe of a different size was made, or when going from a right shoe to a left shoe, or to a shoe of a slightly different style or a shoe having a different heel height. Because of ever-changing styles as well as the numerous combinations of size, heel height and other characteristics of shoes, it is neither practical nor economical to provide specially fitted pads for each different possible shoe bottom contour.

Over many years, the practice developed to try to utilize a compressible, deformable pad for the shoe bottom which somewhat approximates the general range of shoe bottom contours and configurations which can reasonably be expected to be operated on in the machine. This presented a number of significant problems. When a sole is attached with such a pad, the sole press must be operated to develop a high enough pressing force to make sure that the pad will be deformed and pressed into all regions of the shoe bottom to make sure that all of the variously-contoured outsole surfaces are pressed firmly and adhesively against the bottom of the shoe assembly. The greater the difference in shape between the particular shoe assembly and the contour of the pressing pad, the greater is the pressing force required in order to force the pad fully against all surfaces of the outsole under the minimum pressure required. For example, an effort to use a relatively flat pad configuration (which is normally adapated to operate on shoes having a relatively low heel), with a high-heeled shoe (e.g. "Louis" heels) would require enormous press forces in order to force the pad up into the deep shank area typically found in high heels. The forces required to deform a relatively flat pad into the shank and arch region of a high-heeled configuration often will break the heel or in some instances, can even break or damage the last on which the shoe assembly is held. Also among the common problems encountered when extremely high press forces are required in order to deform a pad is that some portions of the usually fibrous outsole will be so compressed against the bottom of the shoe assembly that normally concealed portions of the shoe assembly will "strike through" and be visible, at least in contour, on the bottom of the shoe assembly. This is sometimes called "X-ray" and results in a poor quality shoe.

As the art of sole pressing developed, improvements were made in pad configurations. For example, U.S. Pat. Nos. 2,568,065 and 2,624,057 to Gulbrandsen, disclose arrangements for adjustable sole press pads which are provided with a pad box to support the pad in a manner which enables the contour defined by the upper surface of the pads to be varied to more or less conform to the particular shoe being worked on. While the devices shown in those patents did expand the range of heel heights which could be operated on, that range still was quite narrow, being restricted to more or less comparatively flat shoes, being unable to operate on a shoe having any significant heel height. In addition, the devices shown in the Gulbrandsen patents required a certain degree of operator skill in that the operator had to pre-set a number of cams to settings best adapted to operate on the particular shoe configuration at hand.

In order to press soles of high-heeled shoes, it became the practice in the art to use pad boxes which received various segments of pads which could be arranged as desired in the pad box to form a pad contour which, in the operator's judgment, would do a proper job on the particular high-heeled shoe at hand. Because of the almost infinite combinations and variations of shoe sizes, styles, and heel heights, the selection of the arrangement of pads was a highly-skilled job in which a highly-skilled operator might be called on to select a group of six to eight pads which could be combined, in the operator's judgment, to provide the best pressing contour for the particular shoe bottom. The parameters in such selection were not limited only to the characteristics of the particular shoe. Rather, there also were considerations concerning the type of last on which the shoe was mounted, the hardness and compressibility of the rubber pad segments, the materials used in the shoe assembly and the like. The operation of a sole press and pad box thus became a highly-skilled portion of the shoe manufacturing process.

U.S. Pat. No. 3,052,901, also to Gulbrandsen, attempted to provide a presser pad and pad box for supporting the pad system which would adjust automatically and more closely to the contour of the bottom of the shoe assembly. To that end, the device in the Gulbrandsen 3,052,901 patent utilized a plurality of vertically-oriented, vertically-shiftable shank pads located in the pad box to engage the deep arch in the shank region of a high-heeled shoe or, conversely, to shift to a more flattened configuration for a flatter shoe. The pad box also included a forepart tray and a heel tray which supported the forepart and heel ends of the shoe respectively. A linkage mechanism connected the forepart tray and heel tray to that part of the pad box which supported the vertically-shiftable shank pads. The device was intended to operate so that in response to an increasing pressing force in each of the heel and toe trays, the linkage would transmit part of that increased force to the support for the shank pads to cause the shank pads to be raised upwardly and firmly into the highly-arched shank region of the high-heeled shoe.

Although the device described in U.S. Pat. No. 3,052,901 is among the more widely used pad box systems for sole pressing, it presents numerous difficulties, perhaps the most serious of which is that it does not operate automatically, as was originally intended, except in a very narrow range of heel heights. This was recognized in a later Gulbrandsen U.S. Pat. No. 3,121,241, which acknowledged that the Gulbrandsen pad box did not operate as intended and that it was still necessary for a highly-skilled operator to rearrange pad elements to fit the particular shoe. The Gulbrandsen '241 patent purported to provide a single, changeable pad which would enable the Gulbrandsen pad box, hopefully to be used with a wide range of heel heights but without the necessity for replacing and rearranging many individual vertically-slideable shank pads.

Notwithstanding the remedial approach suggested by the Gulbrandsen U.S. Pat. No. 3,121,241, it has remained common practice to use the Gulbrandsen pad box but with constant selection and rearrangement of numerous individually, vertically-slideable shank pads to build up a shank pad contour best suited for the particular shoe. It is not uncommon for a sole press operator to have a few hundred pads readily available from which to assemble a proper array for the particular shoe.

The present invention provides improvements in pad box structure and mode of operation which overcome the foregoing difficulties.

SUMMARY OF THE INVENTION

The present invention utilizes a pad box of the general type disclosed in the Gulbrandsen U.S. Pat. Nos. 3,052,901 and 3,121,241 with certain modifications to the linkages and articulated supporting members which define the bottom of the box as well as changes to the configuration of compressible pads in the pad box. In particular, the bottom wall which defines the support for the pad elements includes a series of connected segments including a forepart tray, a first link connected to and extended heelwardly from the forepart tray, a second link (referred to in Gulbrandsen as the "shank link") which extends heelwardly from the first link and a third link which is connected to and extends rearwardly from the second link. The second and third links support a heel tray through which the pressing forces on the heel part of the shoe assembly are transmitted.

In the prior Gulbrandsen device, one of the principal objects was to support the heel tray so that the pressing force applied to the heel would be diverted, by connection through the heel tray and second link, to pivot the second link so that part of it would swing upwardly toward the arch of the shoe in see-saw fashion. The vertically shiftable shank pads which were carried in the prior device on the second (shank) link were urged upwardly into the shank region under the influence of the force on the heel tray, as diverted through the linkage to the second (shank) link. In the prior device, the second (shank) link was pivoted at a fixed pivot between its ends.

In contrast with the present invention, the pivot for the second link is not fixed but, instead, is permitted to move freely, at least vertically. In addition, the present invention does not support the vertically-shiftable pads on the second link as does Gulbrandsen but, instead, locates the vertically-shiftable shank pads on the first link. The mode of operation of the device, as so changed, it is very different from the prior Gulbrandsen device. Where an important part of the operation of the prior device was to transmit the force on the heel tray back to the shank pads by the linkage between the heel tray and the see-saw-like second link, the present invention, no fixed pivot for the second link and is not restricted to the see-saw motion required by the prior Gulbrandsen device. With the present invention, none of the downward force on the heel tray is transmitted to the shank pads and downward movement of the heel tray has no effect on the location of the shank pads. The downward movement of the heel tray, however, permits the shoe to shift with respect to the pads which will assure full, complete and forceful pressing engagement with the shoe outsole, whether it is a deeply arched sole or a more shallow outsole and whether or not breast flap attaching also is to be performed.

The invention also includes an improved heel pad which can be adjusted as to its vertical angle to provide more precise and full back-up for the back end of the heel when the sole pressing operation also includes applying a breast flap to the breast of a heel.

The present invention has resulted in a number of unexpected, surprising advantages beyond the ability of the invention to provide proper sole pressing over a wide range of heel heights. It has been found that with the present invention, the distribution of pressing force over the outsole area is far more uniform than with any prior device. As a result, it has been found that the overall force applied by the press to the shoe assembly can be substantially reduced from those which have been commonplace for many years. For example, where it has not been uncommon to require forces of up to 5000 pounds in some sole pressing operations, the same operations now can be carried out with forces of less than half that magnitude. Where less force is applied to the shoe assembly, there is less chance of damaging the last, and there is less chance of striking through ("X-raying") of the outsole, which perhaps are among the more serious difficulties encountered in any sole pressing operation.

It also has been found that with the present invention, pad segments of greater resilience, and lower durometer can be used. The rubber, which is not as hard as that which has been used in the prior device, further enhances the uniformity of pressure distribution over the surface of the outsole.

It is among the general objects of the invention to provide an automatic pad box for use in the sole press operation in which the pad box self adjusts and automatically conforms to a substantial range of shoe heel heights.

A further object of the invention is to provide a pad box of the type described which provides greatly increased uniform pressure distribution over the surface of the shoe outsole.

A further object of the invention is to provide a pad box of the type described which requires substantially less total pressing force than with prior pad box systems.

Another object of the invention is to provide a pad box of the type described which achieves the foregoing advantages while minimizing the chance of last breakage and strike through or X-raying.

Still another object of the invention is to provide a pad box of the type described which has improved heel back-up means to facilitate breast flap applying operations simultaneously with sole pressing and attaching.

Another object of the invention is to provide a device of the type described which achieves the foregoing without any pad changes.

Another object of the invention is to provide an improved pad box which substantially reduces the skill required in operating a sole press system.

Still another object of the invention is to provide modifications and improvements to sole press pad boxes which can easily be made to existing devices already in place in the field.

DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATIVE EMBODIMENT

Figure 1:
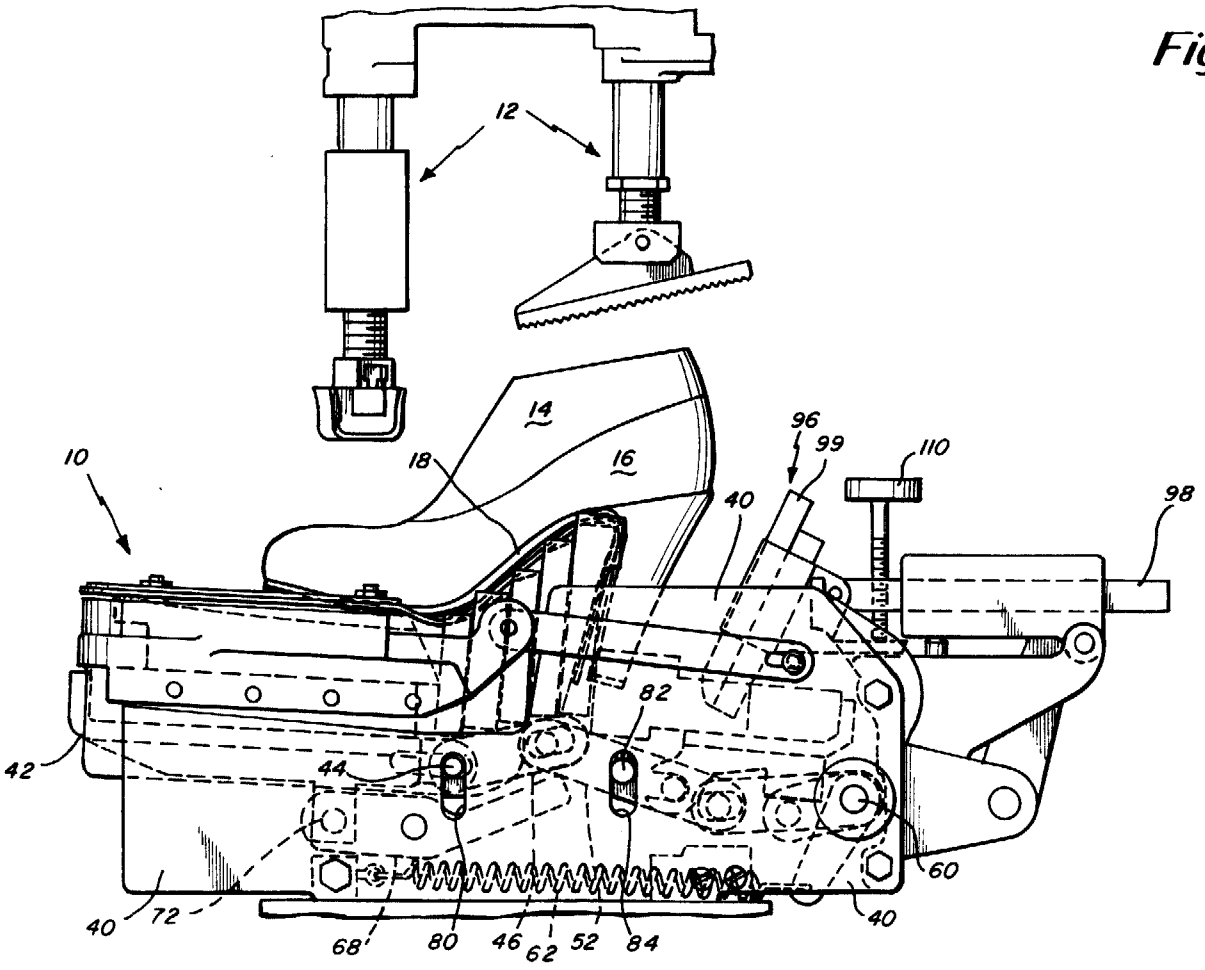
FIG. 1 is a side elevation of the pad box with a high-heeled shoe in place before any pressing force is applied.

As shown in FIG. 1, the sole press machine includes the pad box indicated generally at 10 and an overhead shoe engaging and holddown device, 12. A shoe assembly is placed, bottom down, on the surface of the pad box 10 and the pad box 10 and engaging and holding devices 12 are urged toward each other to press the bottom of the shoe assembly firmly against and into the pad.

The shoe assembly is of conventional form and, as illustrated, may include a last 14 with an upper 16 lasted about the last and an outsole 18 which has been spotted and attached lightly to the bottom of the lasted upper, usually along the flat lasted margin of the upper 16 is well known to one skilled in the art.

Figure 3:
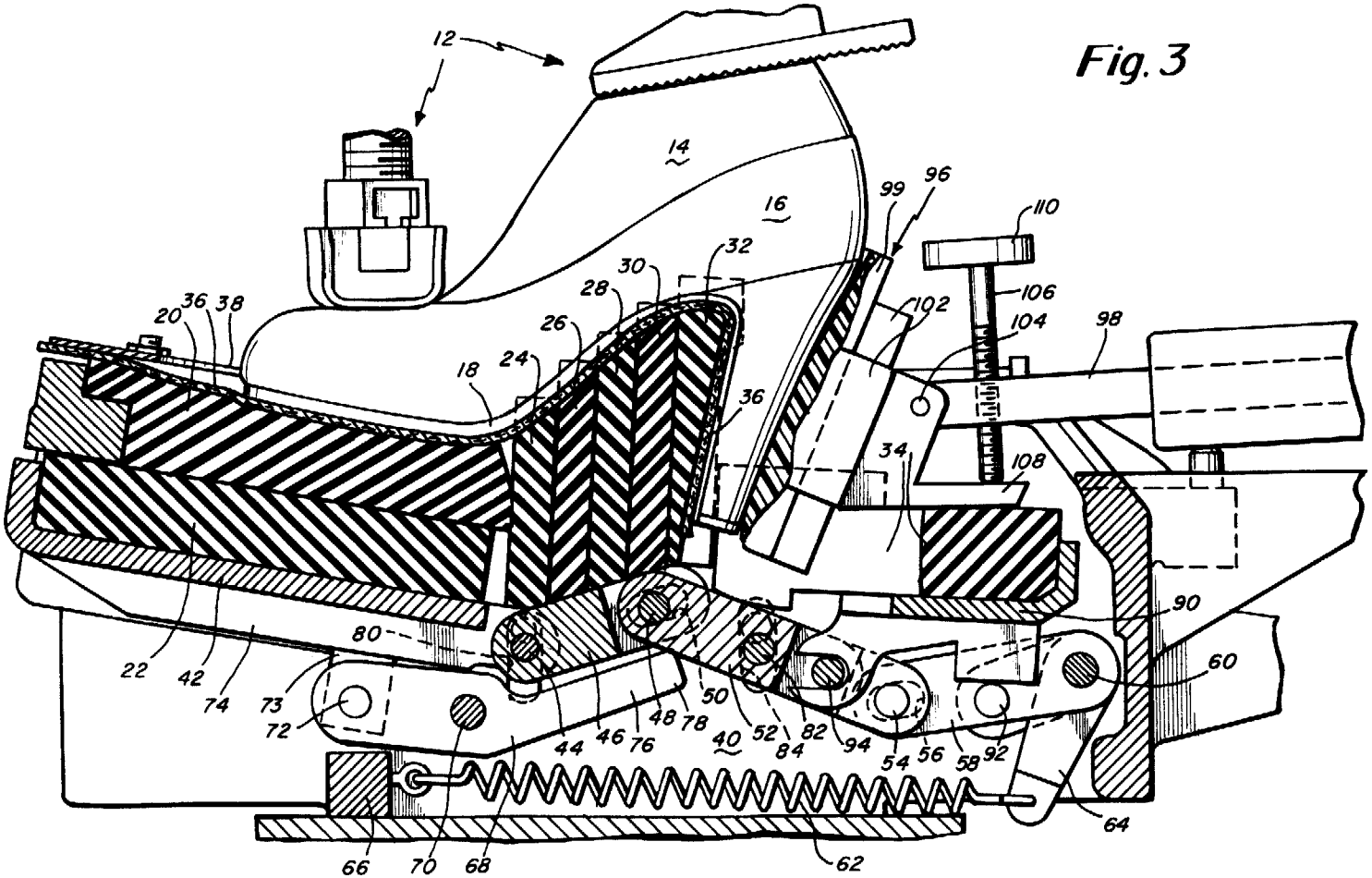
FIG. 3 is a sectional view of the pad box illustrating the configuration of the pad box during a sole pressing operation of a high-heeled shoe (with breast flap attaching)
Figure 4:
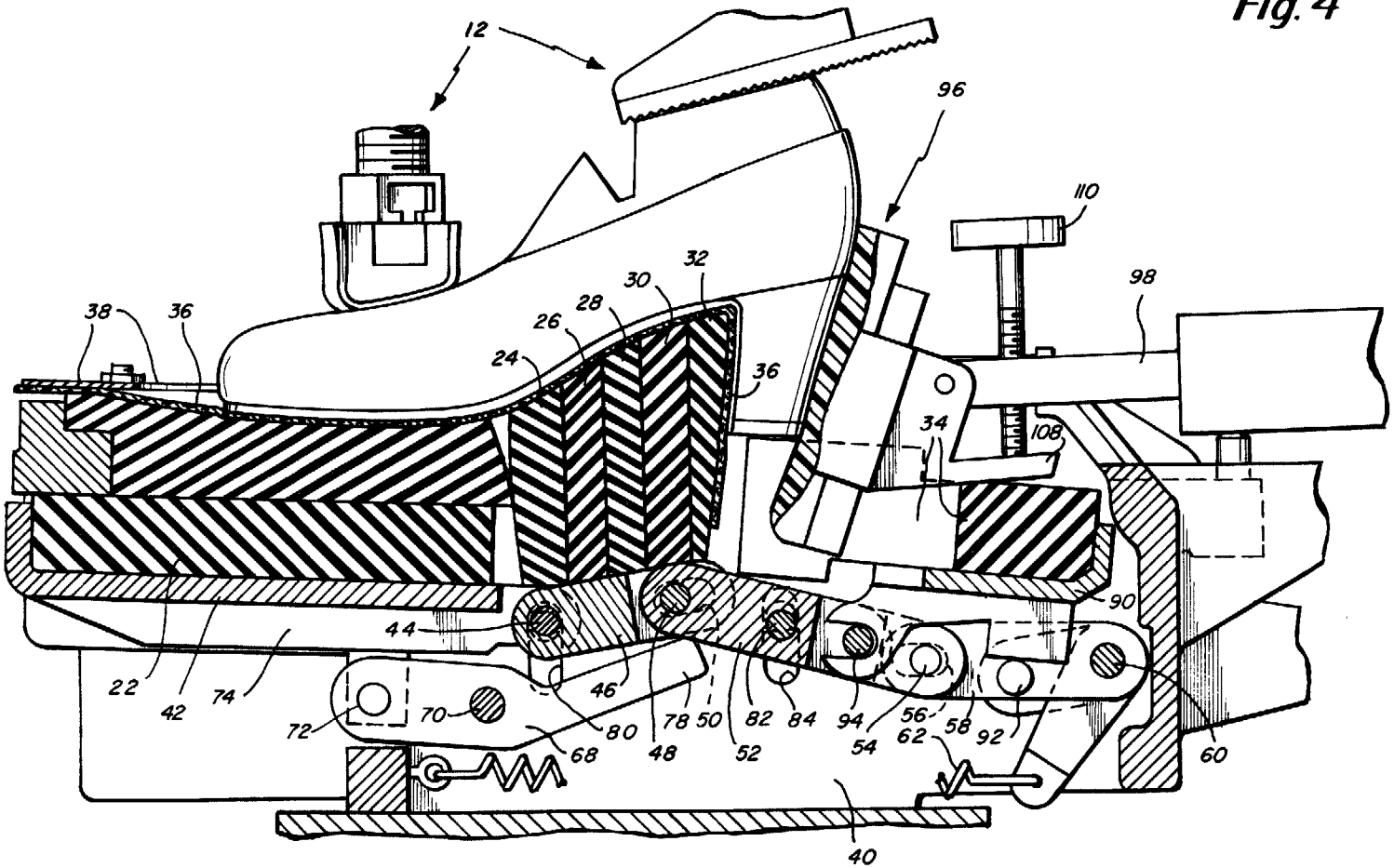
FIG. 4 is an illustration similar to FIG. 3 showing operation of the device on a lower heeled shoe.

As shown in FIGS. 1, 3 and 4, the pad box 10 carries a set of pads which are formed from a solid compressible rubber or equivalent material. In the present invention, the pads include a pair of forepart pads, including an upper forepart pad 20 which lies over a lower forepart pad 22. Located immediately behind the ends of the forepart pads 20, 22 are a group of vertically divided, independently shiftable shank pads 24, 26, 28, 30 and a heel breast pad 32. The arrangement of vertical shank pads 24, 26, 28, 30 and heel breast pad 32 are maintained in a generally vertical configuration and against the rear end of the forepart pads 20, 22 by a filler pad 34. The height of the shank pads 24, 26, 28 and 30 increases progressively, with the heel breast pad 32 being the tallest of all. The upper surfaces of the upper forepart pad 20 and generally contiguous upper edges of the shank pads 24, 26, 28, 30 and heel breast pad 32 are covered by a flexible leather cover 36 which is held in place at its toe end by a retainer plate 38.

The pad box includes a pair of rigid side walls 40 and what may be considered as a flexible, shiftable bottom wall made up of a number of trays and links interconnected to each other in an articulated manner so that the bottom surface of the pad box may shift about thereby supporting the shiftable pads (particularly the shank pads) to conform to the shoe bottom contour. The bottom wall for the pad box includes a forepart tray 42 which supports the forepart pads 20, 22. The rearward end of the forepart tray 42 is pivotally connected, at a pivot pin 44, to a first link 46. The first link 46 is, in turn, connected by a pin 48 and slot 50 arrangement to a second link 52. The second link 52 is connected, at its rearward end, by a pin 54 and slot 56 connection to a lever 58 which is pivoted to the pad box for rotation about the fixed pivot pin 60. The lever 58 is one of a cluster of integral levers which rotate in unison about the fixed pivot 60. The lever 58 (and its associated cluster) is biased in a clockwise direction by a spring 62 which extends from a lever 64 in the cluster to a more forwardly disposed portion of the pad box, such as at the connection 66.

The more forwardly located portions of the pad box bottom are supported by a pair of transversely spaced balancing levers 68 which are pivoted to a transverse pin 70 which is secured in place between the sidewalls 40 of the pad box. The pin 70 is located generally beneath the rearward portion of the forepart tray 42. The forward end of the balancing levers 68 each carries a support pin 72 which pivotally supports a block 73 on which the downwardly extending flanges 74 of the forepart tray rest. The flanges 74 simply rest on top of the blocks 73 to enable the forepart tray 40 to rock with respect to the forward end of the lever 68, at the pins 72. The balancing levers 68 also include a rearwardly extending arm 76, the rearward ends 78 of which engage and provide support for the underside of the articulated pin and slot joint between the first and second links 46, 52. Thus, the entire bottom assembly portion of the pad box may be considered as being supported by the fixed fulcrum pin 60 at the heel end and at freely shiftable pivots at the forward and rearward ends of the balancing levers 68 as defined by the support pin 72 and rear ends 78 of the balancing levers 68.

The pin 44 which connects the forepart tray to the first link 46 is guided for limited vertical movement by means of a vertical slot 80 formed in or carried by each of the pad box side walls 40 receive the transversely projecting ends of the pin. The pinned joint between the forepart tray 42 and the first link 46 thus is permitted to move vertically to define varying angles between the tray 42 and link 46. This enables the forepart tray 42 and first link 46 to assume an angle which will enable the pads, to assume an angle generally corresponding to the angle between the forepart and shank at the ball of the particular shoe assembly.

Among the important differences between the present invention and the prior device described in Gulbrandsen patent is that in the present device, the second link 52 is permitted freedom of motion in a manner which does not interfere with movement of the forepart tray 42 or the first link 46. It should be noted in the prior Gulbrandsen pad box the second link 52 (which was referred to as a "shank link") is not freely movable but, instead, was pivoted at a fixed fulcrum pin at the middle of the link to provide a see-saw action. That pin is illustrated in the present application at 82. It is important to note that the pin 82 in the present invention is not constrained to pivot about a fixed fulcrum point but, rather, is permitted substantial freedom of motion. As shown, the ends of the pin may be contained in a vertically disposed slot 84 formed in the sidewalls. Thus, what served in the Gulbrandsen device as a fixed pivot, requiring a see-saw, levered action for the second link, is omitted from the present invention and results in an action in which the second link has a widely-enhanced degree of freedom of movement, being free not only to pivot but also to shift bodily vertically. It may be noted, that while the present embodiment of the invention is illustrated as providing vertical slots 84 to permit the additional freedom of motion for the pins 82, it appears that the actual range and general direction of movement of the unrestrained link 52 is such that it may be possible to omit the pin 82 entirely.

From the foregoing, it will be appreciated that an important part of the present invention relates to the removal of restrictions to movement of the second link 52. Additionally, it should be noted that in the Gulbrandsen device, the vertical shank pads were disposed on the second link 52, with some being disposed forwardly of the fixed fulcrum and at least one being disposed rearwardly of the fulcrum. In the prior device, the see-saw rocking action of the second link required some of the vertical shank pads to move up while others moved down and still others remained stationary. With the present invention, the vertical shank pads are located on the first link 46 and will assume a configuration dependent on the particular angle at which the first link 46 is inclined. The more forward disposition of the shank pads also has resulted in a forward shifting of the location of the forepart pad 30, but without any change in the relative location of the underlying pad box members. The combination of locating the vertical shank pads more forwardly and on the first link, and removing the restraints to movement of the second link which were previously found in the prior device results in a very different action than that in the prior device.

Also among the significant differences between the present invention and the prior device is the cooperation between the heel supporting members and the pad box linkage. As mentioned above, among the objects in the prior device was to provide an arrangement in which a component of the downward force applied to the heel portion of the shoe assembly was diverted to the second link in a manner to rotate the second link in a direction tending to urge the shank pads upwardly into the shank region of the shoe assembly. With the present invention, the unfulcrumed freedom of motion of the second link 52 prevents any of the heel pressing force from being redirected to the shank pads. This is among the contributing factors to the improved operation of the present invention.

The precise arrangement by which the pad box provides support for the heel portion of the shoe assembly during the pressing operation depends on whether the shoe assembly has a heel attached to it or not, and if it has a heel, the precise type of heel. In each case, the pad box includes a heel tray 90 which is supported for vertical movement in the same manner as described in the prior Gulbrandsen patents. Briefly, the heel tray 90 includes downwardly extending lugs 91 which engage support pins 92 on the rear lever cluster and also a pair of support pins 94 carried by the second link 52. The pins 92, 94 are arranged so that even as the pin and slot connection 54, 56 between the second link and rear lever cluster moves vertically, the heel tray 90 will remain substantially horizontal during its vertical movement.

The heel tray 90 provides support for the rear portion of the filler pad 34. When a shoe with a substantial heel height is being operated on, a heel back-up pad assembly, indicated generally at 96, is brought to bear against the backline of the heel to provide support against the rearward forces acting on the heel by the shank and heel breast pads. The heel backing pad assembly 96 rests on the filler pad 34 to direct a pressing force in the heel region from the shoe downwardly through the heel backing pad 96, the filler pad, the heel tray 90 to the supporting pins 92, 94. The present invention eliminates the Gulbrandsen device, in which such a downward force was transmitted through the see-saw action of the second link 52 to move the shank pads. Thus, whatever downward pressing force is applied to cause the heel tray to move downwardly, that downward action serves only to permit the heel portion of the shoe to shift position, without any simultaneously upward force applied to the shank pads.

When operating on a shoe which has a very low heel attached to it or to which no heel has yet been attached, the space between the bottom of the heel seat portion of the shoe assembly and the filler pad may be taken up by a spacer pad.

FIGS. 3 and 4 illustrate the heel backing pad assembly 96 and supporting assembly which is used when operating on shoes with substantial (but widely varied) heel heights, in which a breast flap is to be attached to the breast portion of the heel. The manner in which the heel support assembly 96 advances into engagement with the heel of the shoe, and the mechanism for moving it in that manner is substantially the same as described and referred to in the prior Gulbrandsen patents. As shown in FIGS. 3 and 4, the heel backing pad assembly 96 is carried on a horizontally reciprocating bar 98 which is moveable toward and away from the heel end of the shoe assembly by mechanisms described in U.S. Pat. No. 3,052,901. The heel backing pad 96 carried on the forward end of the reciprocating bar 98. As described more fully in the aforementioned patents, the reciprocating bar normally is in a rearward position in which the heel backing pad 96 is spaced out of the way and rearwardly from the shoe. As the pressing operation is initiated, the bar 98 advances forwardly to bring the heel backing pad 96 into engagement with the heel of the shoe assembly. Once in engagement with the heel of the shoe assembly, the reciprocating bar 98 also is permitted downward pivotal movement to cause the heel backing pad assembly 96 to be bear on the filler pad and, in turn, on the heel tray as described above. The assembly 96 thus provides back-up for the rearwardly directed forces resulting from pressing of the heel breast portion during the sole attaching operation.

Among the difficulties with the prior art devices, as typified by the Gulbrandsen device, is that the heel backing pad typically had to have a rather precise contour adapted for the particular shoe. The wide variations in shoe sizes, styles, heel shapes and the like coupled with the manner in which the prior pad box operated, prevented the use of a readily adjustible heel backing system which could be easily adjusted to any heel configuration.

Figure 2:
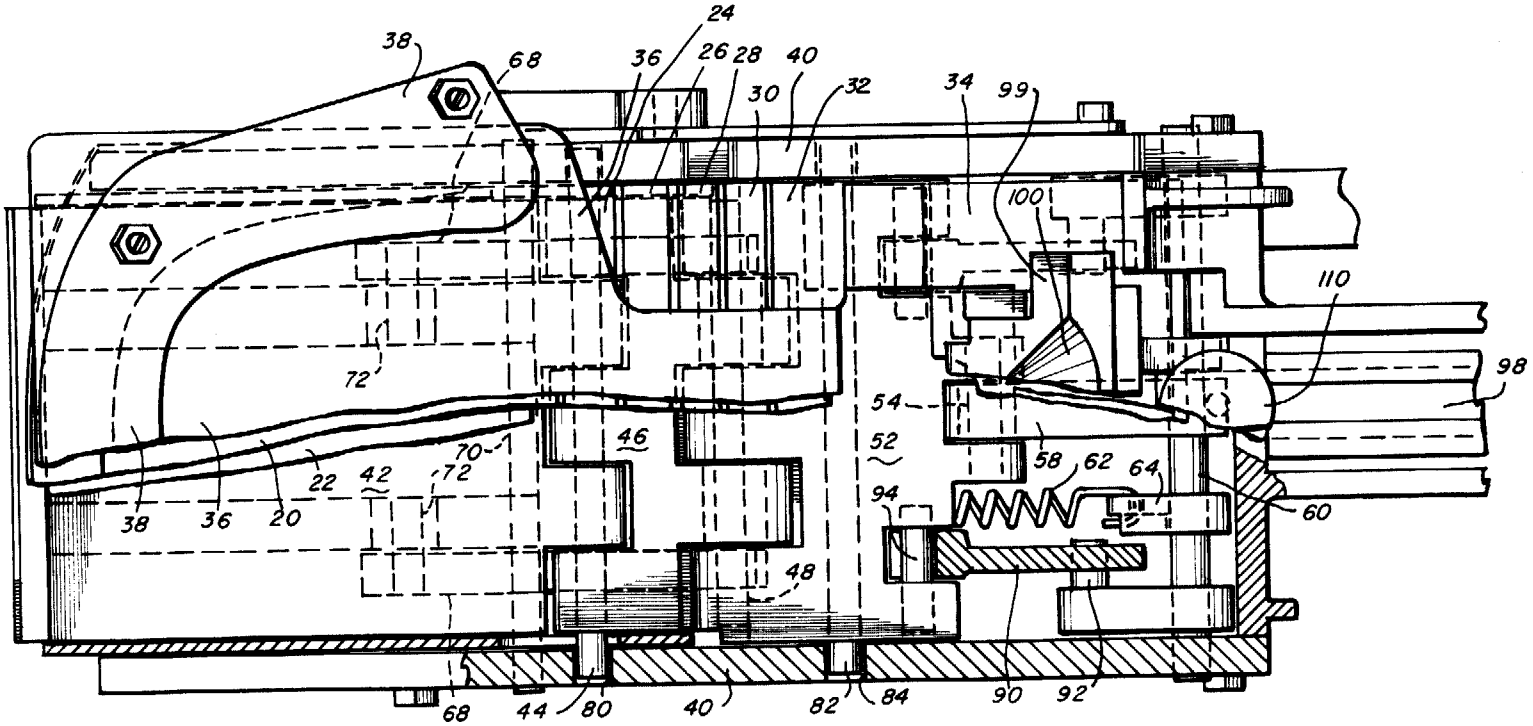
FIG. 2 is a plan view, partly broken away and partly in section of the pad box.

In accordance with the present invention, the heel backing pad 99 is not provided with a special contour adapted specially and substantially only for use with a particular heel configuration. Rather, the pad 99 is generally flat and may be provided with a slightly concave depression indicated at 100 (See FIG. 2). The pad 99 is attached to a pad plate 102 which, in turn, is pivoted at a pin 104 to enable the vertical attitude of the pad plate 102 and pad 99 to be adjusted about a horizontal, transverse axis. The adjustment is made by an adjustment screw 106 which is threaded through the bar 98 downwardly to provide an adjustable stop for a rearwardly protruding portion 108 of the plate 102. A knob preferably is secured to the adjustment screw, as indicated at 110. It should be noted that although the heel adjustment is not automatic, it is made very easily and requires relatively little skill. All the operator need do is make sure that the upper and bottom parts of the heel backing pad 96 engage the corresponding upper and lower parts of the heel.

Also among the features of the invention is that with the modified linkage and revised location for the various pads, a lower durometer rubber can be used for the pads, for example, of the order of about thirty durometer. By employing more resilient pads, the pads can more easily deform themselves to conform to the varying contours of different shoe assemblies but without imparting undue force to the shoe assembly. The use of more resilient pads is less likely to damage the shoe. It should be noted that because the more resilient pads will tend to be deformed greater than the less resilient, higher durometer pads which have been used for many years, the present invention contemplates locating fewer pads, for example four, and with more space between pads, so that the pads, when the device is idle, are arranged in a relatively loose array. The additional space resulting from the relatively loose arrangement of pads assures that there will be adequate room to which the resilient rubber of the pads may flow as they deform.

In operating the device, the shoe, with a lightly attached outsole, is placed on the pad box, the overhead heel and toe abutments 12, having previously been positioned to engage the heel and toe regions of the last as desired. Unless the particular shoe has very little heel or has not yet had a heel attached to it, the heel pad assembly 96 will have been previously adjusted to the desired angle for the particular heel of the shoe which is to be operated on. The machine then may be actuated which, as described in further detail in the aforementioned Gulbrandsen patents, causes relative motion between the pad box 10 and abutments 12. Typically this will involve raising of the pad box, and carrying the shoe upwardly into engagement with the abutments 12. The pad box is raised in two stages described more fully in the aforementioned patents, the first stage being under a relatively light force primarily to position and lightly clamp the shoe between the pad box and the abutments 12. Then the pad box is urged more firmly upwardly under a substantially increased force, to impart a high pressing force to the bottom of the shoe assembly. As described in the Gulbrandsen patents, the heel backing assembly 96 advances into engagement with the heel of the shoe in response to the raised motion of the pad box.

FIG. 1 illustrates the elements of the various linkages and pads which support the shoe assembly when the pad box is in a relaxed position. The forepart tray 42 and the first link 46 will be supported by the pin 72 and rear end 78 of the lever 68 and the pin 44 typically will be in its uppermost position up against the upper end of the slot 80, with the forepart tray 42 and first link 46 assuming relative angles approximately as suggested in FIG. 1. It should be noted that the particular angle or orientation of the second link 52 has no effect on the angular orientation of the forepart tray 42 or first link 46 at this time, or at any time in the subsequent operation of the device. This may be seen from FIG. 1 which illustrates the relative position of the pin 82 in its slot 84.

When the pad box and shoe assembly are raised into the relatively light engagement with the abutments 12, that causes the forepart tray 42 and first link 46 to assume an angle which generally will correspond to the angle between the forepart and shank portion of the shoe. For example, in the relatively high-heel shoe illustrated in FIG. 3, the angle between the forepart tray 42 and first link 46 will be greater than would be the corresponding angle with a lower heeled shoe as suggested in FIG. 4.

After the operator is satisfied with the position of the shoe under the relatively light clamping force, he then treadles the machine to apply the high pressure. This causes further shifting about of the various linkages to an extent and to various relative angles to enable the linkages and pads to assume a configuration corresponding to the particular shoe. It is particularly important in this regard to note that the free-floating action of the second link effectively disables the second link from influencing the configuration of the pads in any way. There are no fixed fulcrums associated with the second link 52, the connection between the second link 52 and each of the first link 46 and third link 58 defining lost motion pin and slot connections. In the present invention, the formerly fixed fulcrum between the ends of the second link 46 now is permitted to float substantially freely, the action of the forepart tray 42 and first link 46 being wholly independent of any movement or forces acting on the second link 52.

The relative locations of the pins 44, 82 within their respective slots 80, 84 as illustrated, in a higher heeled shoe, in FIG. 3. Within each of the slots 80, 84 the respective pins 44, 82 are shown both in solid and in phantom, the phantom position indicating the normal rest position and the solid position indicating the location of the pin when pressure is applied. A similar somewhat diagrammatic illustration is embodied in FIG. 4 which shows substantially the same positions but with a comparatively low-heeled shoe.

As mentioned above, the movement of the second link 52, upon freeing it from its previously fulcrumed restraint, is generally vertical although in some instances it may tend to move slightly horizontally as well with some shoe styles or sizes. Thus, although an embodiment of the invention has been described in connection with a pin 82 for the second link 52 which has been permitted freedom of movement within a vertical slot 84, it also is within the concept of the present invention to completely omit the pin 84, thereby omitting any need for any slot 84.

In the present invention, the primary function for the second link is to provide a forward support for the heel tray, by providing support for the pin 92. The load on the pins 92, however, is retransmitted back to the lever 58 by the pin and slot connection 54, 56. Thus, whether the device is provided with a pin 82 movable within a vertical slot 84 or whether the pin 82 is completely omitted, the second link 52 will be free to move to any position but in a manner which have no effect on the forepart tray 42 or first link 46, or any of the pads supported thereon.

The foregoing arrangement has been found to be very effective on a remarkably wide range of shoes with a wide range of heel heights, for example, between a three and a half inch heel to a one and a half inch heel without any required changes in pads. Moreover, this wide range is achievable in a manner which results in unexpected uniform distribution of pressure along the bottom of the shoe, including a heel breast flap, when that is employed. Even more surprising is the ability of the device to achieve these operating characteristics under pressing forces which are substantially lower than those which heretofore have been conventionally employed.

It should be understood, however, that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. A pad box for applying pressure to the bottom of a shoe assembly comprising:

a pad box frame including side walls and means generally defining a bottom wall, the pad box being receptive to pad elements;

the bottom wall including a plurality of articulated members including a forepart tray for supporting a forepart pad and a rearwardly extending link pivotally connected to the forepart tray;

means for supporting each of the forepart trays and the rear end of the first link on rockable pivot whereby the vertical position of the pivotal connection may be varied, thereby varying the angle between the forepart tray and the first link;

means for guiding the pivotal connection between the forepart tray and first link for movement in a generally heightwise direction;

the first link being adapted to receive a plurality of individual, vertically-shiftable shank pads, the upper ends of which may define generally a surface of a contour engageable with a shank region of a shoe assembly;

the pad box including heel supporting means adapted to provide support for pressing force applied to the heel portion of the shoe, the heel supporting means being constructed and arranged to permit a shoe assembly to advance, downwardly into engagement with shank pad elements on the first link, but without transmitting any force to the forepart tray or the first link.

2. An apparatus as defined in claim 1 further comprising:

the bottom wall of the pad box including a second link connected to the first link, and a lever connected to the rear end of the second link, the lever being pivotally mounted and being located beneath the heel region of a supported shoe assembly, the lever being constructed and arranged so as to receive downwardly directed pressing forces acting on the rear portion of the shoe assembly;

the second link being supported primarily only by its connection with the first link and rear lever whereby movement of the rear lever in response to pressing forces applied to the heel of the shoe assembly will not be transmitted to the first link or the pad support thereon as a result of any movement of the second link.

3. An apparatus as defined in claim 1 further comprising:

at least one forepart pad carried on the forepart tray; and a plurality of said vertically shiftable shank pads disposed on the first link; and means for retaining the shank pads on the first link in a generally vertical arrangement.

4. A device as defined in claim 1 wherein the means for maintaining the shank pads on the first link comprises:

the forepart pad defining a forward abuttment for the forwardmost of the shank pads; and a filler pad located heelwardly of the shank pads and having a forward end which engages the rearwardmost of the vertically arranged shank pads.

5. A device as defined in claim 4 wherein the filler pad is carried by the heel tray and has a forwardly extending portion engageable with the rearwardmost of the shank pads.

6. A pad box for applying pressure to the bottom of a shoe assembly comprising:

a forepart tray adapted to carry a forepart pad;

a first link pivotally connected to the rearward end of the forepart tray and being adapted to carry a plurality of vertically shiftable individual shank pads;

a supporting lever disposed beneath the forepart tray and first link, the lever being pivoted between its ends and having a front pivot adapted to pivotally support the forepart tray and a rear pivot adapted to pivotally support the rearward portion of the first link;

means for guiding the pivotal connection between the forepart tray and first link for movement in a generally heightwise direction;

whereby the forepart tray and first link may assume an angle dependent on the particular configuration of a shoe assembly urged into the upper surface of the forepart pad and shank pads;

means for supporting the heel region of a shoe assembly to provide support during a sole pressing operation, the heel supporting means being free of any linkage to the forepart tray and first link.

7. A machine for pressing a shoe sole into the bottom of a shoe assembly comprising:

a pad box frame including side walls and means generally defining a bottom wall, the pad box being receptive to pad elements;

the bottom wall including a plurality of articulated members including a forepart tray for supporting a forepart pad and a rearwardly extending link pivotally connected to the forepart tray;

means for supporting each of the forepart trays and the rear end of the first link on rockable pivot whereby the vertical position of the pivotal connection may be varied, thereby varying the angle between the forepart tray and the first link;

means for guiding the pivotal connection between the forepart tray and first link for movement in a generally heightwise direction;

the first link being adapted to receive a plurality of individual, vertically-shiftable shank pads, the upper ends of which may define generally a surface of a contour engageable with a shank region of a shoe assembly;

the pad box including heel supporting means adapted to provide support for pressing force applied to the heel portion of the shoe, the heel supporting means being constructed and arranged to permit a shoe assembly to advance, downwardly into engagement with shank pad elements on the first link, but without transmitting any force to the forepart tray or the first link;

abuttment means for the shoe assembly; and means for reflecting relative movement of the shoe abuttments and pad box toward each other thereby to effect a pressing operation on a shoe assembly positioned in the pad box.

8. A method for pressing and attaching a sole to the bottom of a shoe assembly comprising:

supporting the shoe assembly on resilient pads including a plurality of individual, vertically shiftable shank pads and a forepart pad;

supporting the forepart and shank pads in a manner which will enable the upper surfaces of the pad to assume an angular configuration generally conforming to the angle defined between the forepart and shank region of the shoe assembly;

providing a support for the more heelward regions of the shoe assembly;

simultaneously pressing the shoe assembly to apply a sole attaching force to the shoe assembly;

said step of supporting the heel region further comprising supporting the heel independently of the forepart and shank pads and in a manner which will not transmit any of the heelward pressing forces to the forepart or shank pads.

9. A method as defined in claim 8 further comprising isolating the heelward pressing forces from the forces applied to the forepart and shank regions of the shoe assembly.

* * * * *